US005083538A

United States Patent [19]

Hubbell

[11] Patent Number: 5,083,538

[45] Date of Patent: Jan. 28, 1992

[54] ONE-PIECE AIR INTAKE AND FLYWHEEL COVER FOR AN OUTBOARD MARINE ENGINE

[75] Inventor: James C. Hubbell, Fond du Lac, Wis.

[73] Assignee: Brunswick Corporation, Skokie, Ill.

[21] Appl. No.: 641,660

[22] Filed: Jan. 15, 1991

[51] Int. Cl.[5] ..... F02B 77/00

[52] U.S. Cl. ..... 123/198 E; 123/195 C; 181/229

[58] Field of Search ..... 123/52 M, 52 ML, 195 C, 123/195 P, 196 W, 198 E; 181/214, 229, 243; 440/77, 88, 900

[56] References Cited

U.S. PATENT DOCUMENTS

| | | | |
|---|---|---|---|
| 3,800,910 | 4/1974 | Rose | 181/229 |
| 4,522,602 | 6/1985 | Okazaki | 440/77 |
| 4,620,607 | 11/1986 | Breckenfeld et al. | 123/195 C |
| 4,846,300 | 7/1989 | Boda | 440/88 |

FOREIGN PATENT DOCUMENTS

| | | | |
|---|---|---|---|
| 120598 | 7/1984 | Japan | 440/88 |

*Primary Examiner*—Noah P. Kamen
*Attorney, Agent, or Firm*—Andrus, Sceales, Starke & Sawall

[57] ABSTRACT

An air intake system for an internal combustion engine associated with the power head of an outboard marine propulsion system. The engine includes a vertical crank shaft and a flywheel mounted to the crank shaft above the engine block. An air manifold is mounted to the forward side of the engine, and includes an air inlet for receiving intake air. The air intake system includes an air flow path or duct defined by a series of walls, a rearwardly facing air intake opening and a discharge opening for supplying intake air to the air manifold inlet. The engine is enclosed within a cowl assembly, and the air intake opening is located toward the upper end of the cowl assembly interior. The walls defining the air flow duct are formed integrally with a flywheel cover for facilitating assembly of the air flow duct to the engine. The air flow duct minimizes ingestion of water into the engine and reduces engine noise in the boat.

14 Claims, 2 Drawing Sheets

ONE-PIECE AIR INTAKE AND FLYWHEEL COVER FOR AN OUTBOARD MARINE ENGINE

BACKGROUND AND SUMMARY

This invention relates to an internal combustion engine, and more particularly to the air intake system of an internal combustion engine.

In the power head of an outboard marine propulsion system, it is common to employ a two-cycle engine having its crankshaft oriented vertically to provide rotary output power to a vertically oriented drive shaft, with the engine cylinders being oriented horizontally. In a fuel injected engine, an air manifold is mounted to the engine for providing intake combustion air to the cylinders. The air manifold is typically mounted to the forward end of the engine nearest the boat, and includes one or more air inlet openings for receiving intake air for supply to the cylinders through the manifold. The forwardly disposed openings in the air manifold result in a relatively high level of noise in the boat during operation of the engine.

In addition, a commonly recognized problem in marine applications of internal combustion engines is that of keeping water away from the engine. As is known, numerous problems result from ingestion of water into the engine cylinders during operation of the engine.

The present invention has as its object to address the concerns noted above, namely ingestion of water into the engine cylinders and noise experienced by the boat operator and passengers during engine operation. It is a further object of the invention to provide a system for supplying intake air to the air manifold at as low a temperature as possible. Yet another object of the invention is to provide a system for supplying intake air to the air manifold which is simple in its construction and in its mounting to the engine.

In accordance with one aspect of the invention, a one-piece air intake and flywheel cover assembly is provided for the engine associated with the power head of an outboard marine propulsion system. The engine includes an engine block, an air manifold for supplying combustion air to the engine and having an opening for receiving intake air, and a flywheel connected to the end of a crankshaft rotatably mounted to the engine. The one-piece air intake and flywheel cover assembly comprises a flywheel cover portion defining an internal cavity for receiving the flywheel therein, and an air intake portion defining an air flow path including an air intake opening for providing intake air to the air flow path. The air flow path further comprises an air outlet in communication with the air manifold opening for supplying intake air thereto. The air manifold opening is formed in an upper surface of the air manifold, and the air intake portion of the assembly includes an air discharge passage providing a downwardly facing air outlet in communication with the upwardly facing opening in the air manifold. The internal cavity defined by the flywheel cover portion of the assembly includes a substantially circular side wall for covering the outer edge of the flywheel, and the air flow path is defined by an outer wall spaced outwardly from the flywheel cover side wall, with upper and lower walls extending between the outer wall and the flywheel cover side wall.

In accordance with another aspect of the invention, the air intake opening associated with the air flow path faces rearwardly, and the air manifold and its associated opening is located at the forward side of the engine closest to the boat. With this arrangement, engine noise exiting the air manifold through its intake intake opening is directed rearwardly away from the boat operator and passengers, thereby reducing engine noise in the boat. In addition, the length provided by the air flow path acts to attenuate the engine noise, further reducing noise levels in the boat.

In accordance with yet another aspect of the invention, the intake opening associated with the air flow path is located toward the upper end of the engine, which is typically enclosed by a cowl assembly providing one or more air vents for supplying air to the interior of the cowl assembly at the upper portion of the cowl assembly. Placement of the air intake opening in the upper portion of the cowl assembly provides intake air to the intake opening prior to the air passing over the engine, which otherwise would result in warming of the intake air. This prevents elevation of the air temperature, and accordingly avoids the losses in engine horsepower which would result from warmed intake air. Further, locating the air intake opening in the upper portion of the cowl assembly minimizes ingestion of water into the engine along with the intake air.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
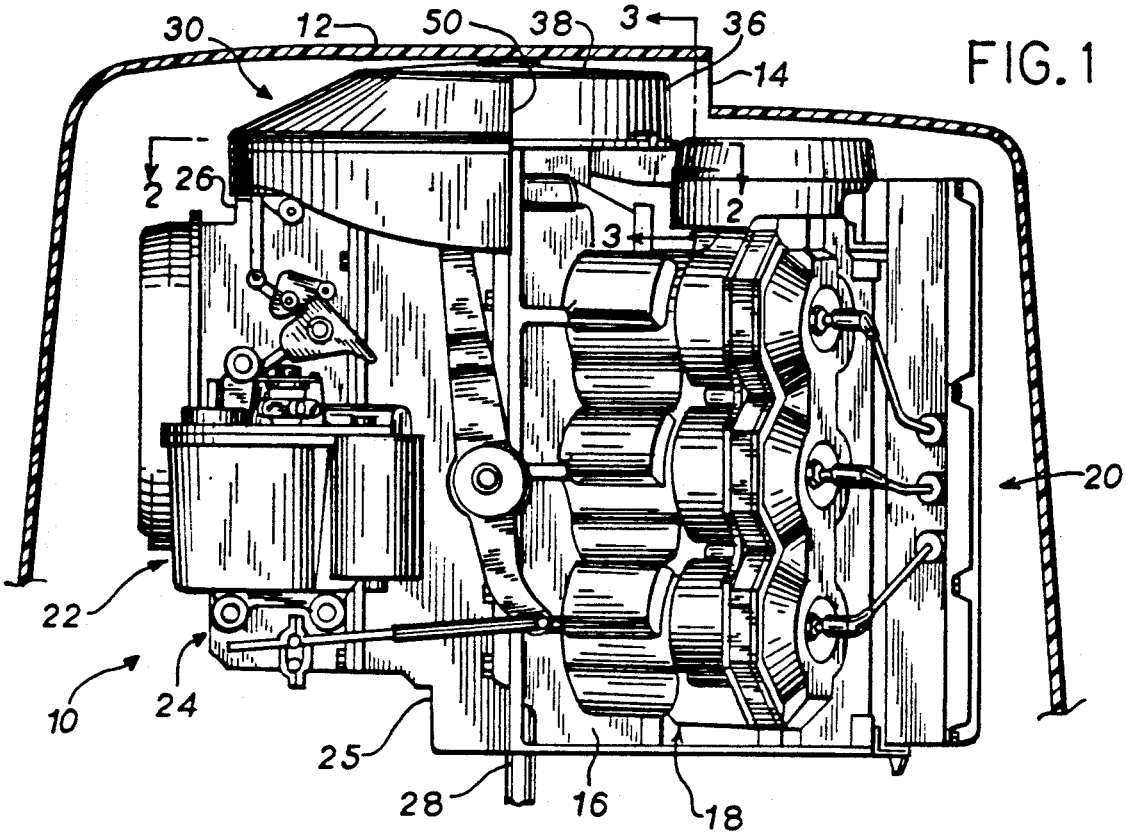
FIG. 1 is a side elevation view of a two-cycle V-6 vertical crank shaft engine incorporating the air intake assembly of the invention.

FIG. 1 illustrates a two-stroke cycle V-6 internal combustion engine 10 associated with the power head of an outboard marine propulsion unit. Engine 10 is housed in the interior of a cowl assembly 12, which is provided with a rearwardly facing air vent 14 for providing air to the interior of cowl assembly 12.

Engine 10 includes an engine block 16 which defines a pair of vertical cylinder banks oriented at an angle relative to each other, to provide a conventional V-shaped engine configuration. One of the cylinder banks is illustrated generally at 18, and includes three horizontally oriented cylinders. The opposite cylinder bank is similarly constructed, thereby forming a V-6 engine. An electrical housing 20 is mounted to engine block 16 between the cylinder banks, and houses the electrical componentry associated with engine 10 in a single location. A vapor separator assembly 22 is mounted to engine 10, for filtering fuel to eliminate contaminants and to separate vapor out of the fuel prior to the fuel being injected through fuel injectors into the interior of engine block 16.

An air manifold 24 is mounted to a rearwardly facing mounting surface associated with a crankcase 25, which is mounted to engine block 16. Air manifold 24 comprises a one-piece member bolted to engine block 16, and is shown and described in copending application Ser. No. 07/641,522 filed on even date herewith, the disclosure of which is hereby incorporated by reference.

The upper surface of air manifold 24 is provided with an upstanding cylindrical portion 26, which provides an upwardly facing opening for supplying intake air into an internal cavity provided in the interior of air manifold 24. A conventional butterfly is mounted within cylindrical portion 26 for controlling the flow of intake air through the upwardly facing opening of air manifold 24. From the internal cavity of air manifold 24, the intake air is supplied through reed valves or the like into the crankcase chamber of engine 10 where it is mixed with fuel injected thereto through a fuel injection system (not shown). The air-fuel mixture is then drawn into the cylinder combustion chambers and is compressed and ignited in accordance with known two-cycle technology, to provide rotary output power to a crank shaft 28, which is oriented along a vertical axis.

Crank shaft 28 extends throughout the height of engine 10 and is rotatably supported within the crankcase chamber, and a flywheel (not shown) is mounted to the upper end of crank shaft 28 above the upper end of engine block 16.

Figure 2:
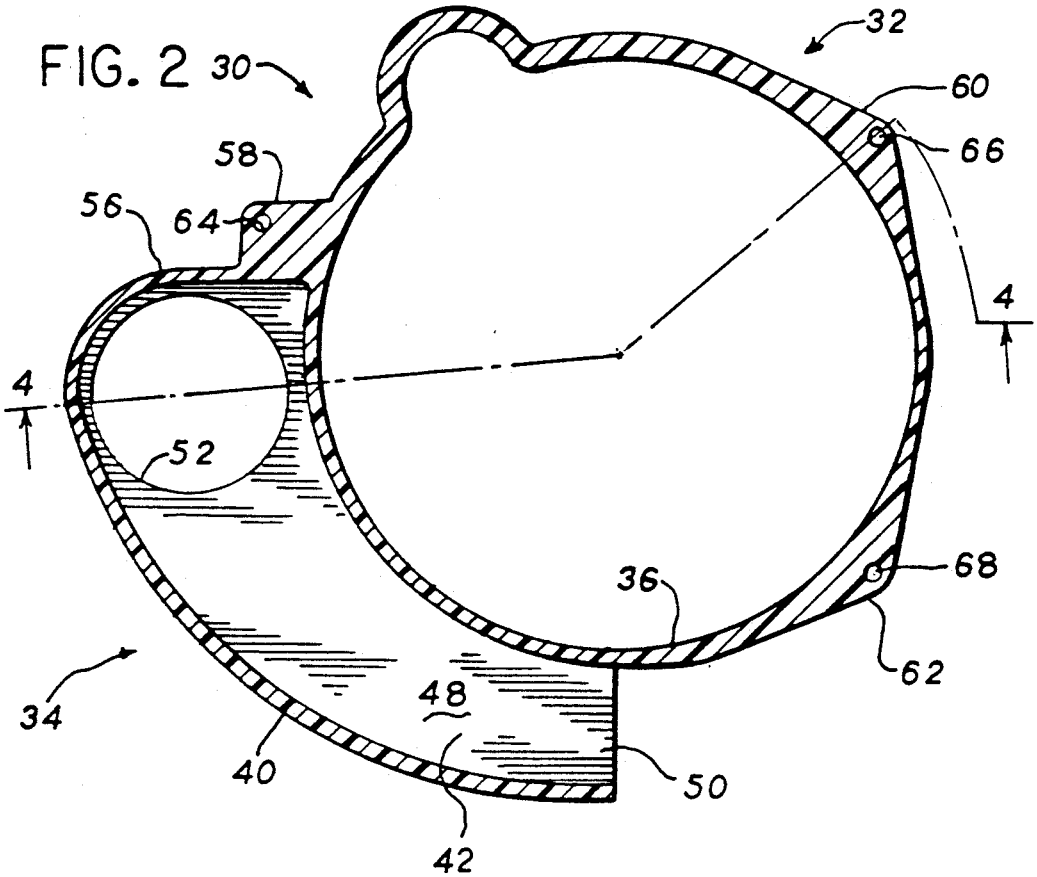
FIG. 2 is a partial sectional view taken generally along line 2—2 of FIG. 1.

A one-piece air intake and flywheel cover assembly 30 is mounted to the upper end of engine block 16. Referring to FIG. 2, assembly 30 generally includes a flywheel cover portion 32 and an air intake portion 34. Flywheel cover portion 32 and air intake portion 34 are formed integrally with each other, preferably by injection molding of a high impact plastic material or the like.

Air intake portion 32 includes a substantially circular side wall 36 and an upper wall 38. Upper wall 38 covers the top of the flywheel, while side wall 36 encloses and covers the outer edge of the flywheel. The bottom of side wall 36 is located below the lower surface of the flywheel.

Air intake portion 34 includes an outer wall 40 which is spaced outwardly from side wall 36, a bottom wall 42 and a top wall 44. Below the lower end of flywheel cover portion side wall 36, air intake portion 34 further includes an inner wall 46 spaced inwardly from outer wall 40 and substantially aligned with the portion of side wall 36 below which it depends.

Air intake portion walls 40, 42, 44 and 46, in combination with a portion of flywheel cover side wall 36, cooperate to define an air flow path 48. An air intake opening 50 defines the entrance to air flow path 48, and air exits air flow path 48 at a discharge opening 52.

Figure 3:
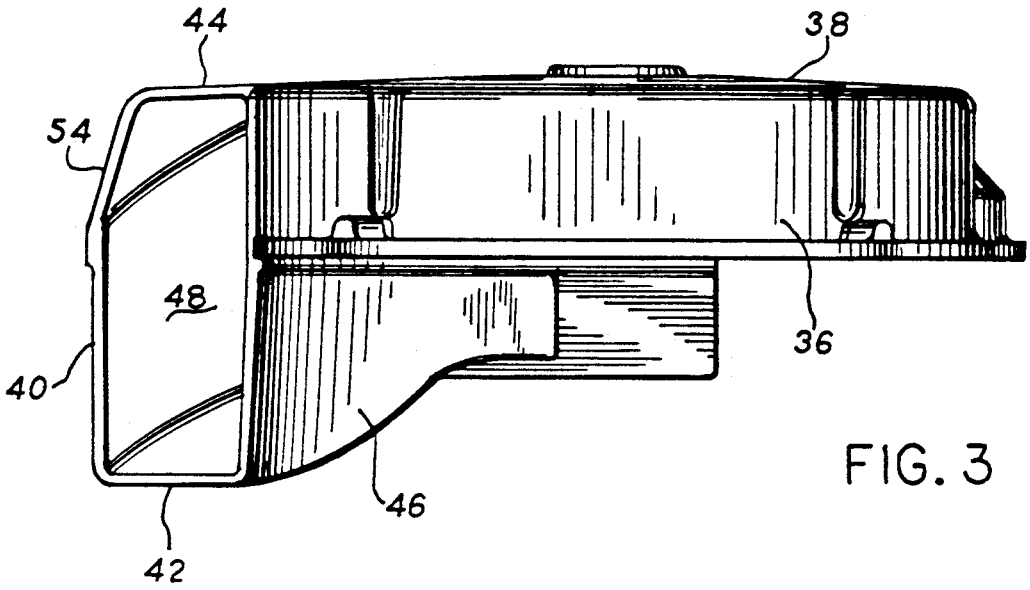
FIG. 3 is a rear elevation view of the air intake assembly of the invention, reference being made to line 3—3 of FIG. 1.

Referring to FIG. 3, air intake opening 50 is substantially in the form of a rectangle with its long axis oriented vertically.

Figure 4:
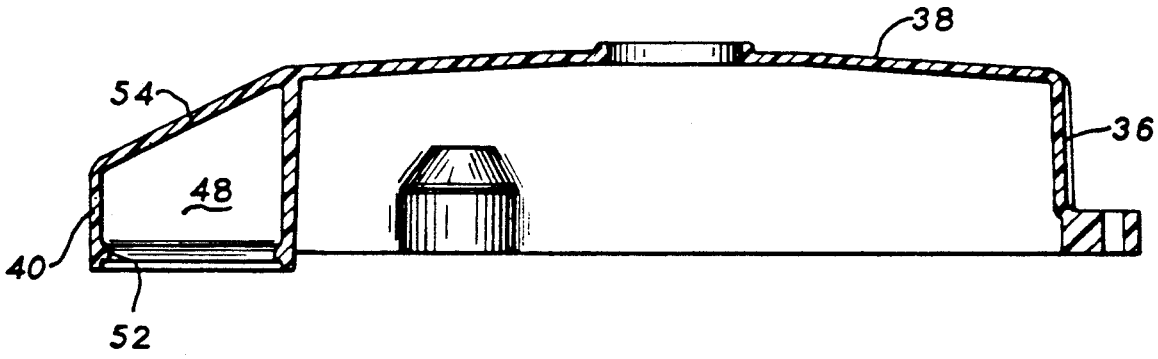
FIG. 4 is a section view taken generally along line 4—4 of FIG. 2.
Figure 5:
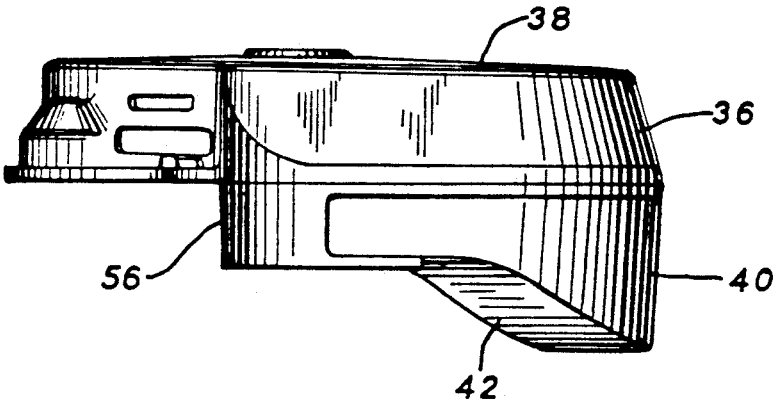
FIG. 5 is a front elevation of the air intake assembly of the invention.

An angled wall 54 cuts off a corner of the rectangular shape of opening 50, extending between wall 40 and top wall 44. Downstream of opening 50, bottom wall 42 curves upwardly toward discharge opening 52, and top wall 44 increasingly narrows while the angle of angled side wall 54 gradually decreases, until the cross-sectional configuration as shown in FIG. 4 is attained.

Outer wall 40 is arcuate in plan and has a radius greater than that of side wall 36, with its center being offset from the center of side wall 36, so that air flow path 48 has its narrowest width at intake opening 50 and its widest width at discharge opening 52, with a smooth transition therebetween. Outer wall 40 extends along with side wall 36 throughout an arc of side wall 36 defining a central angle of 90°. A curved end wall 56 extends between the forward end of outer wall 40 and a mounting lug 58, defining the downstream end of air flow path 48.

Discharge opening 52 faces downwardly and is located at the lower end of a discharge passage defined by end wall 56 in combination with the portions of side wall 36 and outer wall 40 adjacent discharge opening 52. Assembly 30 is mounted to engine block 16 such that opening 52 is in communication with the opening associated with cylindrical portion 26 of air manifold 24, with the area of bottom wall 42 adjacent discharge opening 52 engaging a flange located at the upper end of cylindrical portion 26.

In addition to mounting lug 58, mounting lugs 60 and 62 are provided on side wall 36, and openings 64, 66 and 68 are provided in mounting lugs 58, 60 and 62, respectively. Assembly 30 is mounted to the upper end of engine block 16 by means of threaded fasteners such as machine screws or the like extending through openings 64–68 and into threaded openings formed in the upper end of engine block 16.

As noted previously, air manifold 24 is located on the forward side of engine 10 nearest the boat when the motor is mounted to the boat. The single large air inlet opening associated with air manifold 10 emits engine noise during operation of engine 10. Air intake portion 34 acts to channel the emitted noise through air flow path 48 and out air intake opening 50, which faces rearwardly. With this arrangement, the engine noise is diverted away from the boat operator and passengers, thereby reducing engine noise in the boat. In addition, the length of air flow path 48 acts as a resonator to attenuate the engine noise as it passes therethrough, in accordance with known noise attenuation principles.

Referring again to FIG. 1, and as noted previously, air is supplied to the interior of cowl assembly 12 through rearwardly facing air vent 14 in the upper wall of cowl assembly 12. Air intake opening 50, which is located in the uppermost portion of the interior of cowl assembly 12, receives intake air from the upper volume of the cowl assembly directly from vent 14. That is, the intake air is supplied from vent 14 directly into air intake opening 50 without first passing over engine 10, which otherwise would result in warming of the intake air prior to its passing into intake opening 50. In this manner, the temperature of the intake air is maintained as low as possible. The intake air density thus maximized, resulting in a greater amount of air being supplied to engine 10 and thereby maximum power being output by engine 10. In addition, locating air intake opening 50 in the upper volume of the interior of cowl assembly 12 minimizes the possibility of ingesting water through intake opening 50 along with the intake air. In the event any water is contained within the intake air, the slope associated with lower wall 42 of air flow path 48 causes water which inpinges on lower wall 48 to be discharged outwardly through opening 50 and not ingested into air manifold 24.

Various alternatives and embodiments are contemplated as being within the scope of the following claims particularly pointing out and distinctly claiming the subject matter regarded as the invention.

I claim:

1. For an internal combustion engine for the power head of an outboard marine propulsion system, the engine including an air manifold for supplying combustion air to the engine and having an opening for receiving intake air, and a flywheel connected to the end of a crank shaft rotatably mounted to the engine, a one-piece air intake and flywheel cover assembly, comprising a flywheel cover portion defining an internal cavity for receiving the flywheel therein, and an air intake portion defining an air flow path including an air intake opening for providing intake air to the air flow path, and an air outlet in communication with the air manifold opening for supplying intake air thereto from the air flow path.

2. The assembly of claim 1, wherein the air manifold opening comprises an upwardly facing opening formed in an upper surface of the air manifold, and wherein the air intake portion of the assembly includes an air discharge passage providing a downwardly facing air outlet in communication with the upwardly facing opening in the air manifold.

3. The assembly of claim 2, wherein the air discharge passage is defined by one or more walls adapted for mounting to the air manifold adjacent the air manifold opening.

4. The assembly of claim 2, wherein the flywheel cover portion includes a substantially circular outer wall covering the outer edge of the flywheel, and wherein the air flow path defined by the air intake portion of the assembly includes an arcuate wall spaced outwardly from the circular outer wall of the flywheel cover portion to define the air flow path.

5. The assembly of claim 4, wherein the air manifold is located at the forward side of the engine when the engine is mounted to a boat, and wherein the air flow path extends toward the rear side of the engine, and wherein the air intake opening faces rearwardly, to thereby direct engine noise rearwardly.

6. The assembly of claim 5, wherein the air intake opening is disposed toward the upper portion of the engine.

7. The assembly of claim 6, further comprising a cowl assembly for enclosing the engine and including one or more air vents for supplying air to the interior of the cowl assembly, and wherein the air intake opening is located so as to receive intake air from the cowl vents before the intake air passes over the engine and is warmed thereby.

8. In an internal combustion engine for the power head of an outboard marine propulsion system mounted to a boat, the engine including a combustion air manifold disposed forwardly on the engine facing the boat and having an opening for receiving intake air, and a flywheel mounted to the end of a crankshaft rotatably supported by the engine, the improvement comprising an air intake duct mounted to the engine and including a rearwardly facing air intake opening and a discharge opening in communication with the air manifold opening for supplying intake air thereto, and a flywheel cover mounted to the engine for enclosing the flywheel, and wherein the air duct is connected to the flywheel cover.

9. The improvement of claim 8, wherein the air duct is formed integrally with the flywheel cover.

10. The improvement of claim 8, wherein the flywheel cover includes a substantially circular side wall for covering the outer edge of the flywheel, and wherein the air duct is formed by an arcuate outer wall spaced outwardly from the flywheel cover side wall and extending along a portion of the length of the side wall, the flywheel cover side wall and the outer wall cooperating to form an air flow path therebetween.

11. The improvement of claim 10, wherein the outer wall extends along with the flywheel cover side wall throughout an arc of the side wall defining a central angle of approximately 90°.

12. In an internal combustion engine for the power head of an outboard marine propulsion system mounted to a boat, the engine being enclosed within a cowl assembly and having a combustion air manifold located forwardly on the engine and including an opening for receiving intake air, the improvement comprising an air intake duct mounted to the engine and extending rearwardly, the air intake duct including an air intake opening located toward the upper portion of the cowl assembly and facing rearwardly to reduce engine noise in the boat, wherein the air intake opening receives intake air from an air vent associated with the cowl assembly prior to the intake air passing over the engine, to thereby supply unwarmed intake air to the air manifold, the intake duct further comprising a discharge opening in communication with the air manifold opening for supplying intake air thereto.

13. In an internal combustion engine for the power head of an outboard marine propulsion system, the engine being enclosed within a cowl assembly and having a combustion air manifold including an opening for receiving intake air, the engine further including a flywheel located at the upper end of the engine mounted to the end of a crank shaft rotatably supported by the engine, the improvement comprising an air intake duct mounted to the engine and including an air intake opening located toward the upper portion of the cowl assembly; a discharge opening in communication with the air manifold opening for supplying intake air thereto; and a flywheel cover mounted to the engine for enclosing the flywheel, and wherein the air duct is connected to the flywheel cover.

14. The improvement of claim 13, wherein the air duct is formed integrally with the flywheel cover.

* * * * *